US011078749B2

(12) United States Patent
Al-Abduljabbar

(10) Patent No.: US 11,078,749 B2
(45) Date of Patent: Aug. 3, 2021

(54) TUBULAR WIRE MESH FOR LOSS CIRCULATION AND WELLBORE STABILITY

(71) Applicant: Saudi Arabian Oil Company, Dhahran (SA)

(72) Inventor: Ahmad Mohammad Al-Abduljabbar, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/659,141

(22) Filed: Oct. 21, 2019

(65) Prior Publication Data

US 2021/0115755 A1 Apr. 22, 2021

(51) Int. Cl.
*E21B 33/136* (2006.01)
*E21B 21/00* (2006.01)
*E21B 33/138* (2006.01)

(52) U.S. Cl.
CPC ..... *E21B 33/136* (2013.01); *E21B 21/003* (2013.01); *E21B 33/138* (2013.01)

(58) Field of Classification Search
CPC ..... E21B 33/136; E21B 33/003; E21B 33/138
USPC ..... 166/285
See application file for complete search history.

(56) References Cited

U.S. PATENT DOCUMENTS 5,334,429 A * 8/1994 Imoto ..... B29C 63/34 138/128
6,012,522 A 1/2000 Donnelly et al.
6,250,385 B1 6/2001 Montaron
6,516,506 B2 2/2003 Donnelly et al.
6,679,334 B2 1/2004 Johnson et al.
6,799,637 B2 10/2004 Schetky et al.
7,204,316 B2 4/2007 Dusterhoft et al.
7,380,595 B2 6/2008 Wetzel et al.
(Continued)

FOREIGN PATENT DOCUMENTS

GB 2395214 B 12/2004
WO 2010019535 A2 2/2010
(Continued)

OTHER PUBLICATIONS

International Search Report and Written Opinion for PCT Application No. PCT/US2020/056555 dated Jan. 20, 2021.

*Primary Examiner* — Taras P Bemko
(74) *Attorney, Agent, or Firm* — Bracewell LLP; Constance G. Rhebergen; Linda L. Morgan

(57) ABSTRACT

Systems and methods for sealing a problem zone of a subterranean well include a wire mesh member with a tubular shape and a plurality of openings. The wire mesh member has an initial orientation with an initial outer diameter that is greater than an inner diameter of the wellbore, a reduced orientation with a reduced outer diameter that is less than the inner diameter of the wellbore and an induced bending stress, and an installed orientation with an installed outer diameter that is generally equal to the inner diameter of the wellbore and a residual bending stress. The wire mesh member is positioned within the problem zone and moved to the installed orientation so that an outer surface of the wire mesh member engages an inner surface of the wellbore. The plurality of openings are plugged to prevent a flow of fluid radially through the wire mesh member.

21 Claims, 6 Drawing Sheets

(56) References Cited

U.S. PATENT DOCUMENTS

| | | | | |
|---|---|---|---|---|
| 7,543,639 | B2 | 6/2009 | Emerson | |
| 7,677,321 | B2 | 3/2010 | Spray | |
| 8,800,650 | B2 | 8/2014 | Spray et al. | |
| 8,978,776 | B2 | 3/2015 | Spray | |
| 9,353,584 | B2 | 5/2016 | Allen et al. | |
| 9,587,160 | B2 | 3/2017 | Athey et al. | |
| 2005/0023002 | A1 | 2/2005 | Zamora | |
| 2010/0116495 | A1* | 5/2010 | Spray | E21B 43/108 166/276 |
| 2011/0011577 | A1 | 1/2011 | Dusterhoft | |
| 2011/0214855 | A1 | 9/2011 | Hart et al. | |
| 2013/0068478 | A1* | 3/2013 | Allen | E21B 33/138 166/380 |
| 2014/0076540 | A1 | 3/2014 | Kang | |
| 2018/0230360 | A1* | 8/2018 | Walker | C09K 8/514 |

FOREIGN PATENT DOCUMENTS

| | | | |
|---|---|---|---|
| WO | 2015191055 | A1 | 12/2015 |
| WO | 2016028470 | A1 | 2/2016 |
| WO | 2016043979 | A1 | 3/2016 |
| WO | 2018183319 | A1 | 10/2018 |

* cited by examiner

TUBULAR WIRE MESH FOR LOSS CIRCULATION AND WELLBORE STABILITY

BACKGROUND OF THE DISCLOSURE

1. Field of the Disclosure

The present disclosure relates to subterranean developments, and more specifically, the disclosure relates to sealing a zone of a wellbore with a wire mesh tubular member.

2. Description of the Related Art

During the drilling of subterranean wells, such as subterranean wells used in hydrocarbon development operations, drilling mud and other fluids can be pumped into the well. In certain drilling operations, the bore of the subterranean well can pass through a zone that has induced or natural fractures, are cavernous, or otherwise have a high permeability, and which is known as a loss circulation zone. In addition, wellbore stability issues can occur while drilling in any well and can include hole collapse, or fractures leading to a lost circulation. These issues can be due to weak formations, permeable rocks, or fractures that occurs naturally or are induced while drilling.

In such a case, the drilling mud and other fluids that are pumped into the well can flow into the loss circulation zone. In such cases all, or a portion of the drilling mud and other fluids can be lost in the loss circulation zone.

Lost circulation can be encountered during any stage of hydrocarbon development operations. Lost circulation can be identified when drilling fluid that is pumped into the subterranean well returns partially or does not return at all to the surface. While some fluid loss is expected, excessive fluid loss is not desirable from a safety, an economical, or an environmental point of view. Lost circulation can result in difficulties with well control, borehole instability, pipe sticking, unsuccessful production tests, poor hydrocarbon production after well completion, and formation damage due to plugging of pores and pore throats by mud particles. In extreme cases, lost circulation problems may force abandonment of a well.

Sealing these problematic zones is important before continuing to drill the rest of the well. If the problem zone is not sealed or supported, the wellbore wall can collapse and cause the drill string to get stuck, or the drilling mud can become lost in the formation.

SUMMARY OF THE DISCLOSURE

Currently available solutions for dealing with problem zones, such as loss circulation zones or zones of wellbore instability, include increasing or decreasing the density of the mud weight to control these zones. Adjusting the density of the mud can have unexpected negative consequences. As an example, if a loss circulation zone is encountered the mud weight can be reduced to reduce the loss rate. Because the hydrostatic pressure would be lowered, there is a potential risk of the well flowing in a manner that results in a kick leading to a blowout because the hydrostatic pressure is not sufficient to suppress downhole formation pressure. On the other hand, if a wellbore instability is encountered, such as a formation breakouts, then the mud density could be increased to increase the hydrostatic pressure and add mechanical support against the formation walls. The increase in hydrostatic pressure could break the formation itself or weaken the structure uphole or downhole of the formation leading to induced fractures that cause loss circulation.

Other currently available solutions for a loss circulation zone include sealing the permeable formation by adding bridging materials to the drilling mud. Lost circulation material can seal fractures or vugs where the size of the openings of such fractures or vugs is not overly large. Conventional currently available lost circulation material is most effective at sealing regularly shaped formation voids with widths up to approximately 4-6 millimeters (mm). Currently available lost circulation material can include a blend of material for plugging non-uniform pore sizes. If the size of the opening of the fracture or vug is too large, then in some current lost circulation material, the material used to plug the zone can solidify within the wellbore or within the loss zone. Such an approach can involve trial and error to determine the size of the material that will operate to bridge the problem zone and the correct timing for solidification. Such process can therefore be unreliable and time consuming until the functional parameters are determined.

Where currently available methods of supporting a problem zone include expanding a casing patch against a weak formation, the resulting patch may cover only a portion of the circumference of the wellbore. This will therefore not provide the equivalent of a solid blank pipe. If the wellbore collapses, the spaces between patches may fail, unable to retain the weak formation.

Open hole dads can be installed for supporting a wellbore wall of a problem zone. The steps for installing an open hole clad can include enlarging the hole, then running small tubulars and expanding the tubulars mechanically with high pressure before resuming drilling. In embodiments where the open hole clad is equivalent to a solid blank pipe are provided to support a weak formation, the wellbore is first enlarged to accommodate the support member. Enlarging the wellbore at the problem zone can itself lead to further collapse of the wellbore and weakening of the formation and the time required to perform the bore enlargement can allow for time to pass during which the stability and loss circulation issues can worsen when such issues are time dependent.

Embodiments of the current application instead provide a wire mesh member with a sealing surface with a uniform and known size of the openings. Such openings of the wire mesh member can be successfully plugged with a lost circulation material or swellable material that is known to function reliably with the selected wire mesh openings.

In addition, systems and method described herein do not require for the wellbore to be enlarged to accommodate the wire mesh member. The wire mesh member is sufficiently thin that it does not interfere with further wellbore operations, such as the continued drilling and completion of the well.

In an embodiment of this disclosure, a method for sealing a problem zone of a subterranean well includes delivering a wire mesh member into a wellbore of the subterranean well. The wire mesh member has a tubular shape and a plurality of openings. The wire mesh member has an initial orientation where the wire mesh member has an initial outer diameter that is greater than an inner diameter of the wellbore. The wire mesh member has a reduced orientation where the wire mesh member has a reduced outer diameter that is less than the inner diameter of the wellbore and where the wire mesh member has an induced bending stress. The wire mesh member has an installed orientation where the wire mesh member has an installed outer diameter that is generally equal to the inner diameter of the wellbore and where the wire mesh member has a residual bending stress. The wire mesh member is positioned within the problem zone of the subterranean well. The wire mesh member is moved from the reduced orientation to the installed orientation so that an outer surface of the wire mesh member engages an inner surface of the wellbore. The plurality of openings are plugged to prevent a flow of fluid radially through the wire mesh member.

In alternate embodiments before delivering the wire mesh member into the wellbore, the wire mesh member can be maintained in the reduced orientation with a removable fastener. The removable fastener can be a glue, a weld, or a strap. Moving the wire mesh member from the reduced orientation to the installed orientation can include dissolving the removable fastener. The plurality of openings can be located between parallel longitudinal wires and parallel cross wires. Delivering the wire mesh member into the wellbore of the subterranean well can include delivering wire mesh member through a drill string.

In other alternate embodiments plugging the plurality of openings can include sealing around an entire circumference of the wire mesh member over an entire length of the wire mesh member. Plugging the plurality of openings can include delivering a plugging material through the wellbore to the wire mesh member. Alternately, the wire mesh member can be coated with a swellable material and plugging the plurality of openings can include activating the swellable material. In the installed orientation the wire mesh member can have a wire inner bore with an installed inner diameter. The method can further include after moving the wire mesh member from the reduced orientation to the installed orientation, passing a drill string through the wire inner bore of the wire mesh member.

In another embodiment of this disclosure, a method for sealing a problem zone of a subterranean well includes rolling a wire mesh sheet into a tubular shape to form a wire mesh member having an initial orientation. In the initial orientation the wire mesh member has an initial outer diameter that is greater than an inner diameter of a wellbore of the subterranean well and the wire mesh member is free of bending stresses. The wire mesh sheet is moved from the initial orientation to a reduced orientation. In the reduced orientation the wire mesh member has a reduced outer diameter that is less than the inner diameter of the wellbore and the wire mesh member has an induced bending stress. The wire mesh member is maintained in the reduced orientation with a removable fastener. The wire mesh member is delivered into the wellbore of the subterranean well and positioned within the problem zone of the subterranean well. The removable fastener is dissolved so that the wire mesh member moves from the reduced orientation to an installed orientation and an outer surface of the where mesh member engages an inner surface of the wellbore. In the installed orientation the wire mesh member has an installed outer diameter that is generally equal to the inner diameter of the wellbore and the wire mesh member has a residual bending stress. A plurality of openings of the wire mesh member are plugged to prevent a flow of fluid radially through the wire mesh member between the problem zone of the subterranean well and a wire inner bore of the wire mesh member.

In yet another alternate embodiment of this disclosure a system for sealing a problem zone of a subterranean well includes a wire mesh member having a tubular shape and a plurality of openings. The wire mesh member is positioned within the problem zone of the subterranean well. The wire mesh member has an initial orientation where the wire mesh member has an initial outer diameter that is greater than an inner diameter of the wellbore. The wire mesh member has a reduced orientation where the wire mesh member has a reduced outer diameter that is less than the inner diameter of the wellbore and where the wire mesh member has an induced bending stress. The wire mesh member has an installed orientation where the wire mesh member has an installed outer diameter that is generally equal to the inner diameter of the wellbore and where the wire mesh member has a residual bending stress. The wire mesh member is moveable from the reduced orientation to the installed orientation with an outer surface of the wire mesh member engaging an inner surface of the wellbore. The system further includes a plugging material positioned to plug the plurality of openings and operable to prevent a flow of fluid radially through the wire mesh member.

In alternate embodiments, a removable fastener can be operable to maintain the wire mesh member in the reduced orientation. The removable fastener can be a glue, a weld, or a strap. The removable fastener can be dissolvable to move the wire mesh member from the reduced orientation to the installed orientation.

In other alternate embodiments, the plurality of openings can be located between parallel longitudinal wires and parallel cross wires. In the reduced orientation the wire mesh member can be sized to move through a drill string. An entire circumference of the wire mesh member over an entire length of the wire mesh member can be plugged with the plugging material. The plugging material can be a lost circulation material. The wire mesh member can be coated with a swellable material and the plugging material can be the swellable material. In the installed orientation the wire mesh member can have a wire inner bore with an installed inner diameter sized for a drill string to pass through the wire inner bore.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
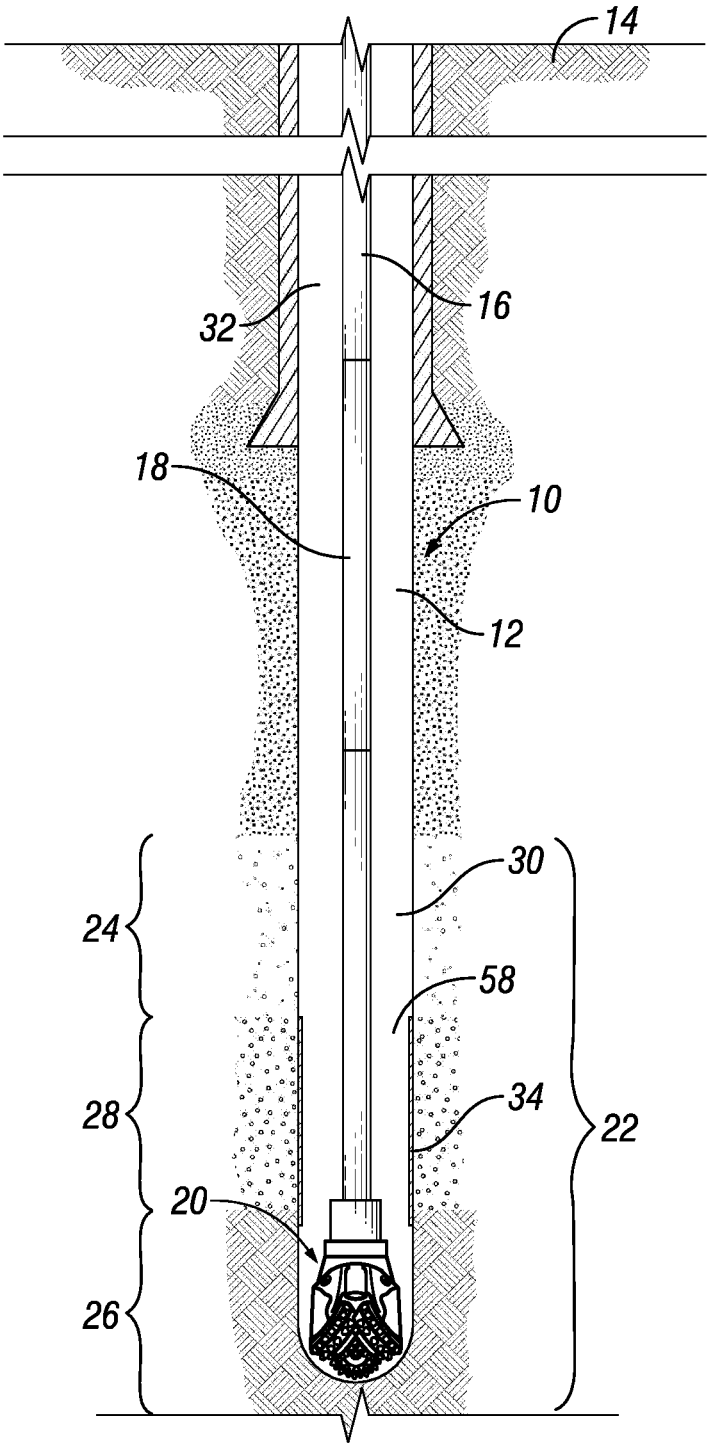
FIG. 1 is a section view of a subterranean well with a system for sealing a problem zone of a subterranean well in accordance with an embodiment of this disclosure, shown with a wire mesh member in the installed orientation.

Looking at FIG. 1, subterranean well 10 can have wellbore 12 that extends to an earth's surface 14. Subterranean well 10 can be an offshore well or a land based well and can be used for producing hydrocarbons from subterranean hydrocarbon reservoirs. Drill string 16 can be delivered into and located within wellbore 12. Drill string 16 can include tubular member 18 and bottom hole assembly 20. Tubular member 18 can extend from earth's surface 14 into subterranean well 10. Bottom hole assembly 20 can include, for example, drill collars, stabilizers, reamers, shocks, a bit sub and the drill bit. Drill string 16 can be used to drill wellbore 12. In certain embodiments, tubular member 18 is rotated to rotate the bit to drill wellbore 12.

Wellbore 12 can be drilled from surface 14 and into and through various formation zones 22 of subterranean formations. Formation zones 22 can include layers of reservoir that are production zones, such as an uphole production zone 24 and a downhole production zone 26. Formation zones 22 can also include an unstable or loss circulation zone, such as problem zone 28. In the example embodiments of FIGS. 1-2, loss problem zone 28 is a layer of the formation zones 22 that is located between uphole production zone 24 and downhole production zone 26. In alternate embodiments, problem zone 28 can be uphole of uphole production zone 24 or downhole of downhole production zone 26. Alternately, problem zone 28 could be identified before any production zone is reached within wellbore 12, or after only one production zone is identified within wellbore 12, or after more than two production zones are identified within wellbore 12.

The formation zones 22 can be at an elevation of uncased open hole bore 30 of subterranean well 10. Drill string 16 can pass though cased bore 32 of subterranean well 10 in order to reach uncased open hole bore 30. Alternately, the entire wellbore 12 can be an uncased open hole bore.

In order to support the sidewall of wellbore 12 at problem zone 28 and further prevent the flow of fluids radially between wellbore 12 and problem zone 28, a system for sealing problem zone 28 of subterranean well 10 can be installed within wellbore 12. The system for sealing problem zone 28 of subterranean well 10 can include wire mesh member 34.

Figure 2:
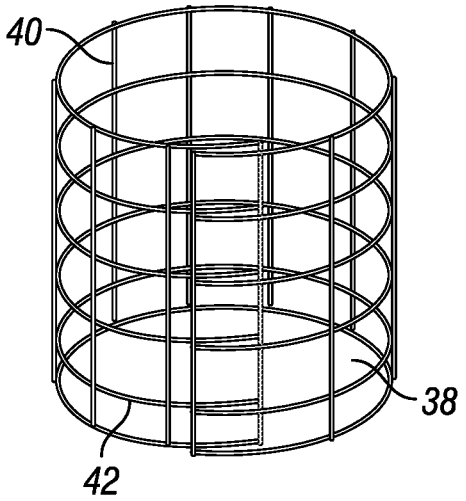
FIG. 2 is a perspective view of a wire mesh member, in accordance with an embodiment of this disclosure, shown in the initial orientation.
Figure 3:
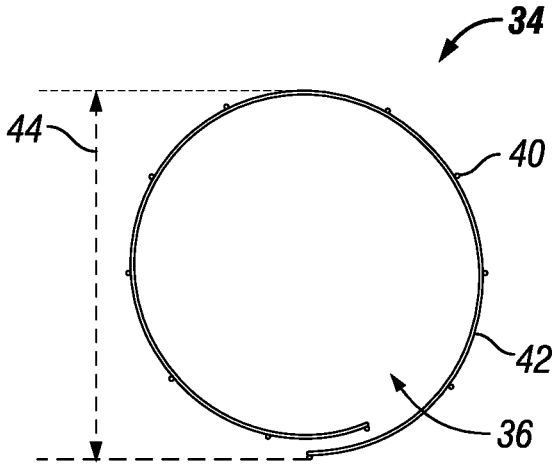
FIG. 3 is a cross sectional view of the wire mesh member of FIG. 2, shown in the initial orientation.

Looking at FIGS. 2-3, wire mesh member 34 has a tubular shape with wire inner bore 36. Wire mesh member 34 is formed of crossed wires, straps, or lines and is not a sheet of metal that contains openings. A sheet with holes would have less flexibility than a wire mesh. The increased flexibility of a wire mesh compared to a solid sheet will allow wire mesh member 34 to be rolled to a smaller diameter to pass through smaller openings when being delivered to problem zone 28. In addition, a wellbore sidewall is not generally smooth or flat, and can be tortious. A wire mesh member can conform to the shape of the inner surface of a wellbore. Further a solid sheet would more likely lay outside of the inner surface of the wellbore. A wire mesh can instead be pushed against the inner surface of the wellbore and have sufficient flexibility not only to conform to the shape of the inner surface of the wellbore, but can also be partially or fully pressed into the formation, reducing the effect that wire mesh member 34 will have on the inner diameter measurement of the wellbore.

Wire mesh member 34 has a plurality of openings 38. Each of the openings 38 can have a size in a range of a number of millimeters (mm). In an example embodiment each of the openings 38 can have a size in a range of 1 mm to 5 mm. In alternate embodiments an opening 38 can have a size that is smaller than 1 mm or larger than 5 mm. Wire mesh member 34 can be formed of a thin wire mesh having parallel longitudinal wires 40 and parallel cross wires 42. Wire mesh member 34 can have a thickness in a range of a number of mm. In an example embodiment wire mesh member 34 can have a thickness in a range of 1 mm to 5 mm. In alternate embodiments wire mesh member 34 can have a thickness that is smaller than 1 mm or larger than 5 mm.

Wire mesh member 34 can be a flexible member formed of a strong and flexible material that enables wire mesh member 34 to bend without deformation. The material used to form wire mesh member can bend, maintain potential energy in a bent configuration, and return to an original shape when unbent. The material that forms wire mesh member 34 will withstand downhole conditions such as formation pressure and temperature, wellbore hydrostatic pressure and formation fluids such hydrocarbon and corrosive fluids such hydrogen sulfide and carbon dioxide. The material forming wire mesh member 34 can also have an internal yield pressure that can withstand the temperature and pressure of a downhole environment, while having a Young modulus to allow for sufficient flexibility. As an example, wire mesh member can be formed of steel. Alternately, wire mesh member 34 could be formed, for example, of steel alloys, or nickel titanium.

In the Example of FIGS. 2-3 wire mesh member 34 is in an initial orientation. In the initial orientation, wire mesh member 34 has an initial outer diameter 44. Initial outer diameter 44 is greater than an inner diameter of wellbore 12 (FIG. 1). In order to form wire mesh member 34, a wire mesh sheet can be rolled into a tubular shape. In the initial orientation, the ends of the wire mesh sheet that forms wire mesh member 34 can overlap by an initial amount. In alternate embodiments, in the initial orientation the ends of the wire mesh sheet that forms wire mesh member 34 may not overlap. In the initial orientation the wire mesh sheet has been rolled into a tubular shape in such a way that wire mesh member 34 is free of bending stress. When no outside forces are acting on wire mesh member 34, wire mesh member 34 remains in the initial orientation.

Figure 4:
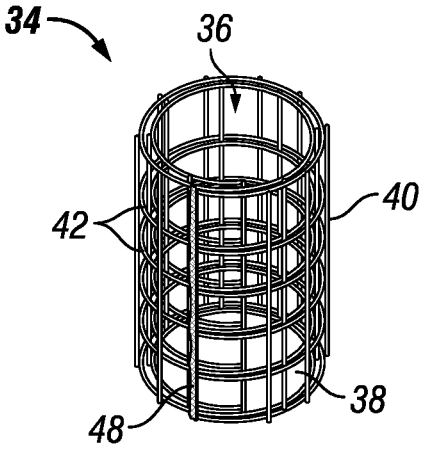
FIG. 4 is a perspective view of a wire mesh member, in accordance with an embodiment of this disclosure, shown in the reduced orientation and retained with weld or glue.
Figure 5:
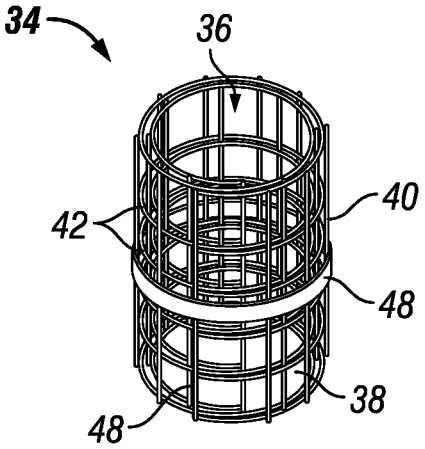
FIG. 5 is a perspective view of a wire mesh member, in accordance with an embodiment of this disclosure, shown in the reduced orientation and retained with a strap.
Figure 6:
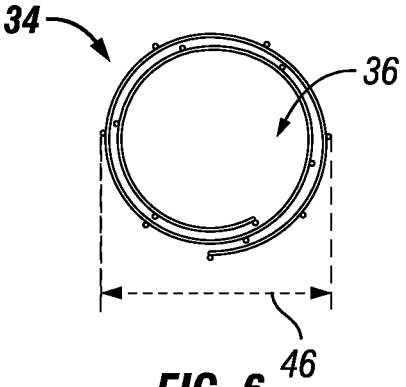
FIG. 6 is a cross sectional view of the wire mesh member of FIG. 4, shown in the reduced orientation.

Looking at FIGS. 4-6, in order to deliver wire mesh member 34 into wellbore 12, wire mesh member 34 is moved to a reduced orientation. In the reduced orientation wire mesh member 34 has a reduced outer diameter 46 that is less than the inner diameter of wellbore 12. In order to reduce the outer diameter of wire mesh member 34, wire mesh member 34 is rolled into a tighter tubular member and the ends of the wire mesh sheet that form wire mesh member 34 overlap a greater amount than when wire mesh member 34 is in the initial orientation.

In the reduced orientation, wire mesh member 34 has an induced bending stress. If no external force is applied to wire mesh member 34 in the reduced orientation, wire mesh member 34 will expand and return to the initial orientation. Removable fastener 48 can be used to maintain wire mesh member 34 in the reduced orientation so that wire mesh member 34 can be delivered into wellbore 12. Removable fastener 48 can be a tie such as a strap, a weld, glue or other destructible, dissolvable, or disappearing material. In embodiments of this disclosure, removable fastener 48 is a glue, a weld, or a strap that can be dissolved to remove removable fastener 48. Looking at FIG. 4, removable fastener 48 can be, for example, a glue or weld that is applied to wire mesh member 34 where an end of the wire mesh sheet overlaps another layer of the rolled wire mesh sheet. Looking at FIG. 5, removable fastener 48 can alternately be a strap that is wound around wire mesh member 34. Removable fastener 48 can be formed of a material that will dissolve under downhole conditions, such as, for example, a metal-based component such as alloys or similar, or a plastic or polymer based elements, or similar.

With wire mesh member 34 in the reduced orientation, wire mesh member 34 can be delivered into wellbore 12 of subterranean well 10. Wire mesh member 34 can be delivered into wellbore 12 with a wireline, coiled tubing, or other cable or tubular member. In alternate embodiments, wire mesh member 34 can be delivered into wellbore 12 by fluid forces of a fluid that is pumped into wellbore 12. In embodiments where there are no internal strings within wellbore 12, wire mesh member 34 can be lowered within or dropped into wellbore 12 alone.

Figure 7A:
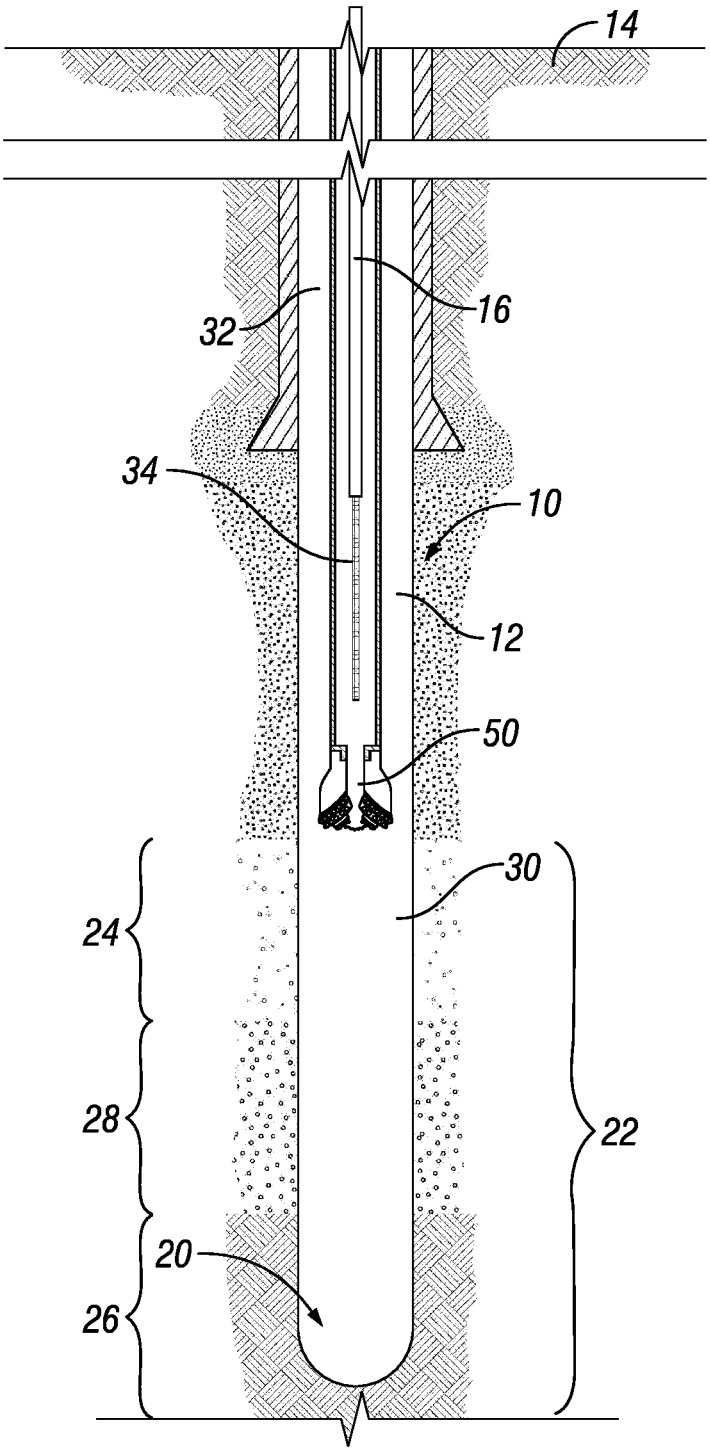
FIG. 7A is a section view of a subterranean well with a system for sealing a problem zone of a subterranean well in accordance with an embodiment of this disclosure, shown with the wire mesh member in the reduced orientation and being delivered through the drill string.

Looking at FIG. 7A, in embodiments where drill string 16 is located within wellbore 12, wire mesh member 34 can be moved to a reduced orientation where wire mesh member is sized to move through drill string 16. Wire mesh member 34 can have reduced outer diameter 46 that is less than an inner bore of drill string 16. In such an embodiment, wire mesh member 34 can be delivered through drill string 16. In the embodiment shown in FIG. 7A, drill string 16 includes a drill bit. Wire mesh member 34 can be moved to a reduced orientation with reduced outer diameter 46 that is less than an inner diameter of bit nozzle 50 and wire mesh member can be lowered out of a downhole end of drill string 16 through bit nozzle 50. In alternate embodiments, drill string 16 can be an open ended drill pipe that does not include a drill bit. In such an embodiment, wire mesh member 34 can be lowered out of the open downhole end of drill string 16.

Figure 7B:
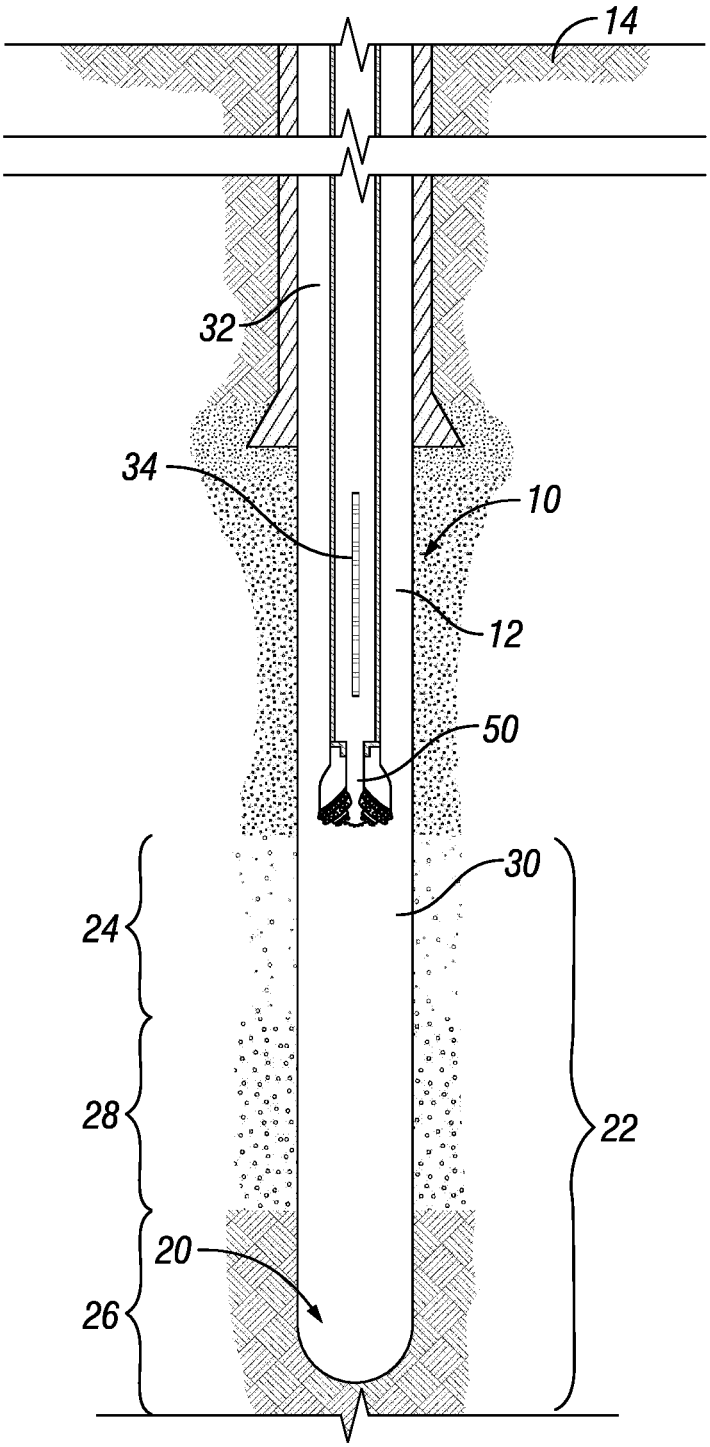
FIG. 7B is a section view of a subterranean well with a system for sealing a problem zone of a subterranean well in accordance with an embodiment of this disclosure, shown with the wire mesh member in the reduced orientation and being dropped through the drill string.

Looking at FIG. 7B, in alternate embodiments wire mesh member 34 is moved to a reduced orientation where wire mesh member is sized to move through drill string 16 with reduced outer diameter 46 that is less than an inner diameter of bit nozzle 50. Wire mesh member 34 can then be dropped through drill string 16 from the surface without wire mesh member 34 being attached to any device for lowering wire mesh member 34. In other alternate embodiments where there is no string within wellbore 12, after wire mesh member 34 is moved to a reduced orientation, wire mesh member can be dropped through wellbore 12 from the surface without wire mesh member 34 being attached to any device for lowering wire mesh member 34.

Wire mesh member 34 can be delivered into wellbore 12 to problem zone 28 of subterranean well 10. In embodiments where wire mesh member 34 can be lowered through drill string 16, the time required to deliver wire mesh member 34 to problem zone 28 is reduced compared to currently available technology that requires the removal of drill string 16 in order to deliver wire mesh member 34 to problem zone 28 of wellbore 12.

After wire mesh member 34 reaches problem zone 28, removable fastener 48 can be removed. In embodiments where removable fastener 48 is dissolvable, removable fastener 48 can be dissolved, such as with the temperature downhole. Alternately a hot fluid, acid, or other fluid capable of weakening, breaking or dissolving removable fastener 48 can be pumped within wellbore 12 to remove removable fastener 48. With the removal of removable fastener 48, wire mesh member will move from the reduced orientation to the installed orientation due to the induced bending stress.

Figure 8:
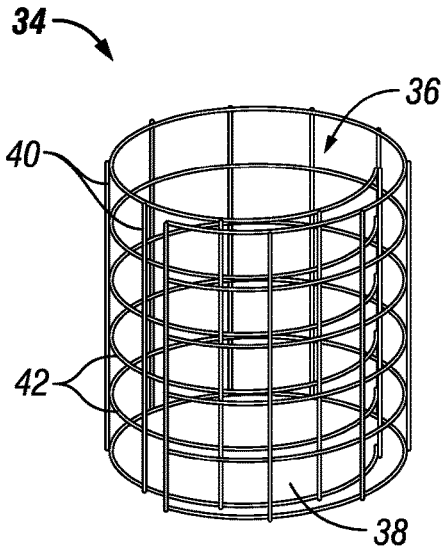
FIG. 8 is a perspective view of a wire mesh member, in accordance with an embodiment of this disclosure, shown in the installed orientation.
Figure 9:
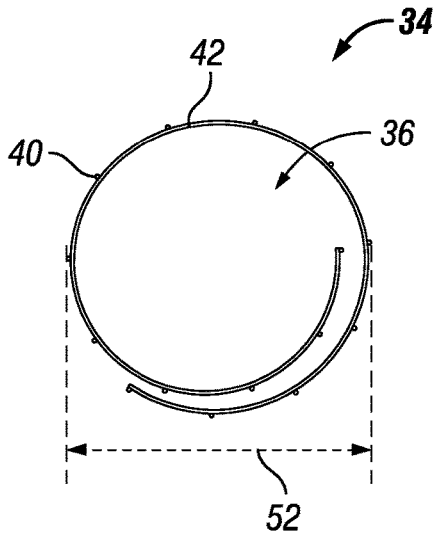
FIG. 9 is a cross sectional view of the wire mesh member of FIG. 8, shown in the installed orientation.

Looking at FIGS. 8-9, in the installed orientation wire mesh member 34 has installed outer diameter 52. When wire mesh member 34 moves to the installed orientation, installed outer diameter 52 will be generally equal to the inner diameter of wellbore 12 because an outer surface of wire mesh member 34 engages the inner diameter surface of wellbore 12. In the installed orientation the ends of the wire mesh sheet that form wire mesh member 34 overlap a greater amount than when wire mesh member 34 is in the initial orientation, and a lesser amount than when wire mesh member 34 is in the reduced orientation.

Installed outer diameter 52 is less than initial outer diameter 44 so that wire mesh member 34 has a residual bending stress. This residual bending stress of wire mesh member 34 will act radially outwards on the inner diameter surface of wellbore 12, which will help to maintain the position of wire mesh member 34 within problem zone 28 of wellbore 12. In certain embodiments, problem zone 28 is later cased with a casing that is cemented in place so that the residual bending stress is used to maintain the position of wire mesh member 34 until problem zone 28 is cased.

In embodiments of this disclosure, the inner diameter of wellbore 12 at problem zone 28 is not enlarged relative to adjacent portions of wellbore 12. Enlarging the inner diameter of wellbore 12 would require additional time and equipment compared to embodiments of this disclosure where no enlargements of wellbore 12 at problem zone 28 is performed. Because wire mesh member 34 is formed of a thin wire sheet, the inner diameter of wire inner bore 58 of wire mesh member 34 is not significantly smaller than the inner diameter of wellbore 12, therefore wellbore 12 does not have to be enlarged at problem zone 28 in order to install wire mesh member 34. Because wire mesh member 34 is flexible and can conform to the inner surface of wellbore 12, wire mesh member 34 will decrease the inner diameter of wellbore 12 by an amount that is within the tolerance range for the variations in wellbore diameter from normal drilling operations. As an example, a diameter of wellbore 12 can be up to 4% larger than the drill bit used to drill wellbore 12. In embodiments, wire mesh member can decrease the inner diameter of wellbore 12 by an amount that is less than 4% of the diameter of the drill bit used to drill wellbore 12, even when the inner diameter of wellbore 12 is non-uniform.

In order to seal problem zone 28 and prevent the flow of fluids between wellbore 12 and problem zone 28, the plurality of openings 38 can be plugged. With the openings 38 plugged, a flow of fluid radially through wire mesh member 34 is prevented. Plugging openings 38 with plugging material 54 will result sealing around an entire circumference of wire mesh member 34 over an entire length of wire mesh member 34. As a result, wire mesh member 34 will act or be equivalent to a solid blank pipe member.

Figure 10A:
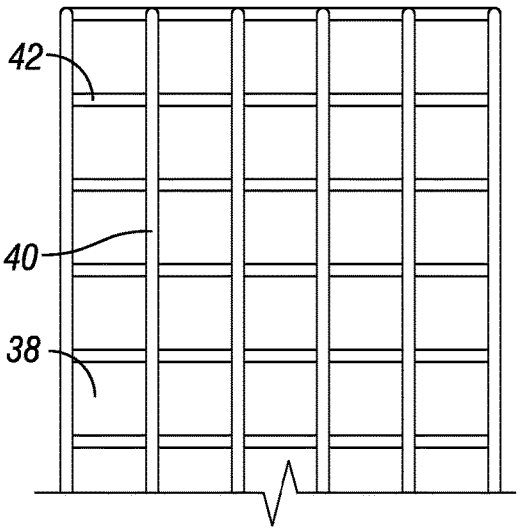
FIG. 10A is a detailed elevation view of a portion of a wire mesh member, in accordance with an embodiment of this disclosure.
Figure 10B:
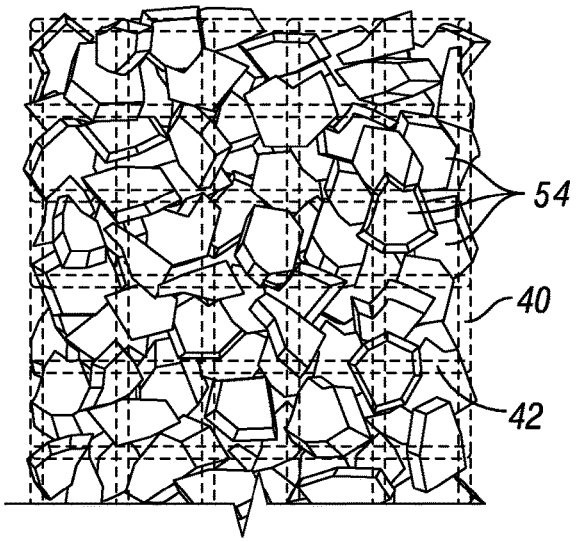
FIG. 10B is a detailed elevation view of a portion of a wire mesh member, in accordance with an embodiment of this disclosure, shown with plugging material positioned to plug the plurality of openings in the wire mesh member, where the plugging material is a lost circulation material.

Looking at FIGS. 10A-10B, plugging the plurality of openings can be accomplished by delivering a plugging material 54 through wellbore 12 to wire mesh member 34. The size distribution of plugging material 54 will be designed to match the size of the plurality of openings 38 in order to efficiently plug all of the openings 38. In embodiments of this disclosure, plugging material 54 can be a lost circulation material. Plugging material 54 can accumulate at the openings 38 to plug all of the openings 38 of wire mesh member 34.

Plugging material 54 can include a product of various shapes and sizes to ensure proper plugging of the wire mesh. In general, biggest size of plugging material 54 will be about one third of the wire mesh opening. As an example, if the wire mesh has an opening size of 5 mm, plugging material will have a largest size in a range of 1500-2000 micron. Plugging material 54 can include smaller sized material, such as material with a size in a range of 200-500 microns. Plugging material 54 can include fibers, flakes, round, and granules. Plugging material 54 can be formed of calcium carbonate ($CaCO_3$), graphite, nut shells, wood, cotton hulls, and other known types of lost circulation material. Plugging material 54 will be formed of a mixture of types, sizes and shapes is to effectively bridge off openings 38 of wire mesh member 34. The fibers will create a net that can trap other smaller shapers. The larger sized material will plug openings 38 first, then the smaller sized material can fill in the gaps in openings 38.

Figure 11A:
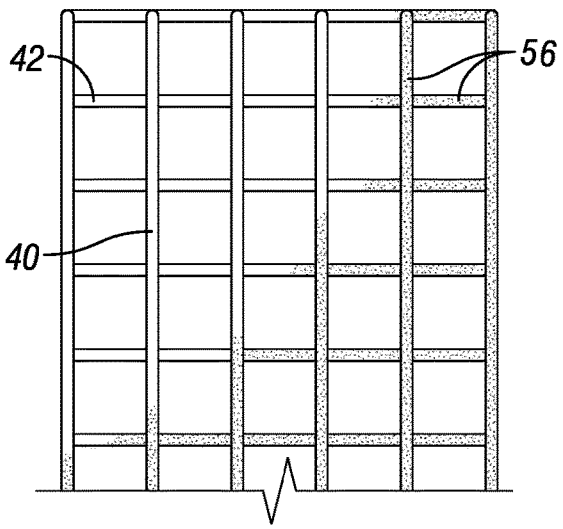
FIGS. 11A-11C are detailed elevation views of a portion of wire mesh member, in accordance with an embodiment of this disclosure, where the plugging material is a swellable material.
Figure 11B:
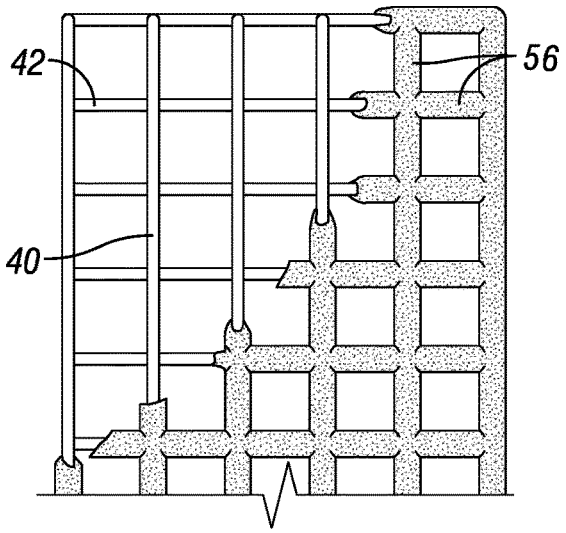
Figure 11C:
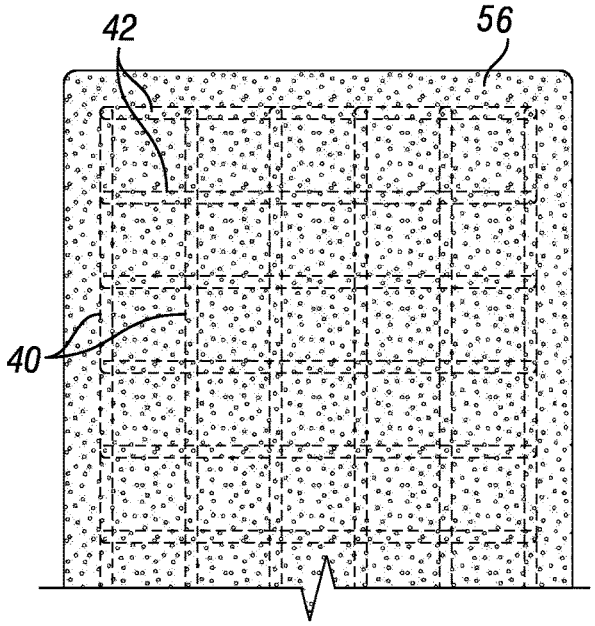

Looking at FIGS. 11A-11C, in alternate embodiments of this disclosure, wire mesh member 34 is coated with a swellable material 56. The size of openings 38 and the amount of swellable material 56 can be selected so that swellable material 56 will fill each of the openings 38. In such an embodiment, plugging the plurality of openings 38 includes activating swellable material 56. Swellable material 56 can accumulate at the openings 38 to plug all of the openings 38 of wire mesh member 34. Plugging openings 38 with swellable material 56 will result sealing around an entire circumference of wire mesh member 34 over an entire length of wire mesh member 34. As a result, wire mesh member 34 will act or be equivalent to a solid blank pipe member. Swellable material 56 can swell in presence of an activation fluid. Swellable material 56 can be formed of, as an example, polymer hydrogel, such as hydrophilic polymer, thermoplastic elastomer, or other suitable swellable composition. Swellable material 56 can be activated by water, oil, or a mix of water and oil. After wire mesh member 34 is in the installed orientation the activation fluid will be pumped that causes swellable material 56 to swell in place and plug all of the openings 38 to form a blank body. Such a blank body with both prevent fluid from passing radially through wire mesh member 34 and support the inner diameter wall of wellbore 12. In certain embodiments the activation fluid that causes swellable material 56 to swell can be the same fluid that removes removable fastener 48.

With problem zone 28 sealed and the sidewall of wellbore supported at problem zone 28, operations within subterranean well 10 can continue. As an example, drilling operations within wellbore 12 can be resumed. Looking at FIG. 1, wire mesh member 34 can have wire inner bore 58. Wire inner bore 58 is sized so that drill string 16 can pass though wire inner bore 58 so that drilling operations of wellbore 12 can be continued. Wire inner bore 58 can also be sufficiently large that well completion operations and other well development and operation procedures can be undertaken.

In an example of operation and looking at FIG. 1, in order to seal problem zone 28 of wellbore 12 wire mesh member 34 can be delivered into wellbore 12. Before being delivered into wellbore 12, wire mesh member 34 can be moved from the initial orientation to the reduced orientation. In the reduced orientation wire mesh member 34 is sized to be moved through a wellbore that does not have a string, or sized to be moved through drill string 16. Wire mesh member 34 can be maintained in the reduced orientation with removable fastener 48.

When wire mesh member 34 has reached problem zone 28, removable fastener 48 can be removed, such as by being destructed, dissolved, worn out, or by disappearing. In the reduced orientation, wire mesh member 34 has an induced bending stress so that after removable fastener is removed, wire mesh member 34 moves to the installed orientation. In the installed orientation an outer surface of wire mesh member 34 engages an inner surface of wellbore 12. Such engagement retains wire mesh member 34 in position within wellbore 12 at problem zone 28. The openings 38 through wire mesh member 34 can then be plugged, such as with plugging material 54 or swellable material 56. Plugging openings 38 prevents a flow of fluid radially through wire mesh member 34 and supports the sidewall of wellbore 12 at problem zone 28.

Embodiments described in this disclosure therefore provide a thin wire mesh that becomes the equivalent of a solid pipe for sealing and supporting a problem zone. Because the wire mesh is thin, there is no need to enlarge the problem zone of the wellbore. If a minor hole enlargement would be required, then a simple acid or other well treatment can be used to enlarge the wellbore just enough to accommodate the wire mesh member. The bending stress of the wire mesh will be sufficient to retain the wire mesh in the desired position within the wellbore so that no slips or other anchoring elastomers or devices are required to retain the wire mesh.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method for sealing a problem zone of a subterranean well, the method including:

delivering a wire mesh member formed of a rolled wire mesh sheet into a wellbore of the subterranean well, where the wire mesh member has a tubular shape and a plurality of openings, and where the wire mesh member has:

an initial orientation where the wire mesh member has an initial outer diameter that is greater than an inner diameter of the wellbore;

a reduced orientation where the wire mesh member has a reduced outer diameter that is less than the inner diameter of the wellbore and where the wire mesh member has an induced bending stress, where an end of the wire mesh member has reduced orientation overlap that is greater than a circumference of the wire mesh member, such that the wire mesh member has at least two layers of the wire mesh member over the entire circumference of the wire mesh member; and an installed orientation where the wire mesh member has an installed outer diameter that is generally equal to the inner diameter of the wellbore, where the end of the wire mesh member has an installed overlap that is less than the circumference of the wire mesh member, such that the wire mesh member has two layers of the wire mesh member over a length of the circumference of the installed overlap and a single layer of the wire mesh member over a remaining circumference, and where the wire mesh member has a residual bending stress;

positioning the wire mesh member within the problem zone of the subterranean well;

moving the wire mesh member from the reduced orientation to the installed orientation so that the end of the wire mesh member moves a distance that is longer than the circumference of the wire mesh member from the reduced orientation overlap to the installed overlap, and so that an outer surface of the wire mesh member engages an inner surface of the wellbore; and plugging the plurality of openings to prevent a flow of fluid radially through the wire mesh member.

2. The method of claim 1, further including before delivering the wire mesh member into the wellbore, maintaining the wire mesh member in the reduced orientation with a removable fastener.

3. The method of claim 2, where the removable fastener is selected from a group consisting of a glue, a weld, and a strap.

4. The method of claim 2, where moving the wire mesh member from the reduced orientation to the installed orientation includes dissolving the removable fastener.

5. The method of claim 1, where the plurality of openings are located between parallel longitudinal wires and parallel cross wires.

6. The method of claim 1, where plugging the plurality of openings includes sealing around an entire circumference of the wire mesh member over an entire length of the wire mesh member.

7. The method of claim 1, where plugging the plurality of openings includes delivering a plugging material through the wellbore to the wire mesh member, where the plurality of openings are sized to be larger than the largest size of the plugging material, and the plugging material is sized to bridge a across the plurality of openings.

8. The method of claim 1, where the wire mesh member is coated with a swellable material and where plugging the plurality of openings includes activating the swellable material so that the swellable material fills the plurality of openings and the plurality of openings are sealed around the entire circumference of the wire mesh member so that the wire mesh member forms a solid tubular member.

9. The method of claim 1, where in the installed orientation the wire mesh member has a wire inner bore with an installed inner diameter, and where the method further includes after moving the wire mesh member from the reduced orientation to the installed orientation, passing a drill string through the wire inner bore of the wire mesh member.

10. A method for sealing a problem zone of a subterranean well, the method including:

delivering a wire mesh member into a wellbore of the subterranean well, where the wire mesh member has a tubular shape and a plurality of openings, where delivering the wire mesh member into the wellbore of the subterranean well includes delivering wire mesh member through a drill string, and where the wire mesh member has:

an initial orientation where the wire mesh member has an initial outer diameter that is greater than an inner diameter of the wellbore;

a reduced orientation where the wire mesh member has a reduced outer diameter that is less than the inner diameter of the wellbore and where the wire mesh member has an induced bending stress; and an installed orientation where the wire mesh member has an installed outer diameter that is generally equal to the inner diameter of the wellbore and where the wire mesh member has a residual bending stress;

positioning the wire mesh member within the problem zone of the subterranean well;

moving the wire mesh member from the reduced orientation to the installed orientation so that an outer surface of the wire mesh member engages an inner surface of the wellbore; and plugging the plurality of openings to prevent a flow of fluid radially through the wire mesh member.

11. A method for sealing a problem zone of a subterranean well, the method including:

rolling a wire mesh sheet into a tubular shape to form a wire mesh member having an initial orientation, where in the initial orientation the wire mesh member has an initial outer diameter that is greater than an inner diameter of a wellbore of the subterranean well and where the wire mesh member is free of bending stresses;

moving the wire mesh sheet from the initial orientation to a reduced orientation, where in the reduced orientation the wire mesh member has a reduced outer diameter that is less than the inner diameter of the wellbore and where the wire mesh member has an induced bending stress, where an end of the wire mesh member has reduced orientation overlap that is greater than a circumference of the wire mesh member, such that the wire mesh member has at least two layers of the wire mesh member over the entire circumference of the wire mesh member;

maintaining the wire mesh member in the reduced orientation with a removable fastener;

delivering the wire mesh member into the wellbore of the subterranean well and positioning the wire mesh member within the problem zone of the subterranean well;

dissolving the removable fastener so that the wire mesh member moves from the reduced orientation to an installed orientation and an outer surface of the where mesh member engages an inner surface of the wellbore, where in the installed orientation the wire mesh member has an installed outer diameter that is generally equal to the inner diameter of the wellbore, where the end of the wire mesh member has an installed overlap that is less than the circumference of the wire mesh member, such that the wire mesh member has two layers of the wire mesh member over a length of the circumference of the installed overlap and a single layer of the wire mesh member over a remaining circumference, and where the wire mesh member has a residual bending stress; and plugging a plurality of openings of the wire mesh member to prevent a flow of fluid radially through the wire mesh member between the problem zone of the subterranean well and a wire inner bore of the wire mesh member; where moving the wire mesh member from the reduced orientation to the installed orientation causes the end of the wire mesh member to move a distance that is longer than the circumference of the wire mesh member from the reduced orientation overlap to the installed overlap.

12. A system for sealing a problem zone of a subterranean well, the system including:

a wire mesh member formed of a rolled wire mesh sheet and having a tubular shape and a plurality of openings and positioned within the problem zone of the subterranean well, where the wire mesh member has:

an initial orientation where the wire mesh member has an initial outer diameter that is greater than an inner diameter of the wellbore;

a reduced orientation where the wire mesh member has a reduced outer diameter that is less than the inner diameter of the wellbore and where the wire mesh member has an induced bending stress, where an end of the wire mesh member has reduced orientation overlap that is greater than a circumference of the wire mesh member, such that the wire mesh member has at least two layers of the wire mesh member over the entire circumference of the wire mesh member; and an installed orientation where the wire mesh member has an installed outer diameter that is generally equal to the inner diameter of the wellbore, where the end of the wire mesh member has an installed overlap that is less than the circumference of the wire mesh member, such that the wire mesh member has two layers of the wire mesh member over a length of the circumference of the installed overlap and a single layer of the wire mesh member over a remaining circumference, and where the wire mesh member has a residual bending stress;

where the wire mesh member is moveable from the reduced orientation to the installed orientation with an outer surface of the wire mesh member engaging an inner surface of the wellbore, the end of the wire mesh member moving a distance that is longer than the circumference of the wire mesh member from the reduced orientation overlap to the installed overlap; and the system further includes a plugging material positioned to plug the plurality of openings and operable to prevent a flow of fluid radially through the wire mesh member.

13. The system of claim 12, further including a removable fastener operable to maintain the wire mesh member in the reduced orientation.

14. The system of claim 13, where the removable fastener is selected from a group consisting of a glue, a weld, and a strap.

15. The system of claim 13, where the removable fastener is dissolvable to move the wire mesh member from the reduced orientation to the installed orientation.

16. The system of claim 12, where the plurality of openings are located between parallel longitudinal wires and parallel cross wires.

17. The system of claim 12, where an entire circumference of the wire mesh member over an entire length of the wire mesh member is plugged with the plugging material.

18. The system of claim 12, where the plugging material is a lost circulation material, where the plurality of openings are sized to be larger than the largest size of the plugging material, and the plugging material is sized to bridge across the plurality of openings.

19. The system of claim 12, where the wire mesh member is coated with a swellable material and where the plugging material is the swellable material, the swellable material filling the plurality of openings, such that the plurality of openings are sealed around the entire circumference of the wire mesh member so that the wire mesh member forms a solid tubular member.

20. The system of claim 12, where in the installed orientation the wire mesh member has a wire inner bore with an installed inner diameter sized for a drill string to pass through the wire inner bore.

21. A system for sealing a problem zone of a subterranean well, the system including:

a wire mesh member having a tubular shape and a plurality of openings and positioned within the problem zone of the subterranean well, where the wire mesh member has:

an initial orientation where the wire mesh member has an initial outer diameter that is greater than an inner diameter of the wellbore;

a reduced orientation where the wire mesh member has a reduced outer diameter that is less than the inner diameter of the wellbore and where the wire mesh member has an induced bending stress; and an installed orientation where the wire mesh member has an installed outer diameter that is generally equal to the inner diameter of the wellbore and where the wire mesh member has a residual bending stress; where the wire mesh member is moveable from the reduced orientation to the installed orientation with an outer surface of the wire mesh member engaging an inner surface of the wellbore;

where in the reduced orientation the wire mesh member is sized to move through a drill string; and the system further includes a plugging material positioned to plug the plurality of openings and operable to prevent a flow of fluid radially through the wire mesh member.

* * * * *